US009757636B1

(12) United States Patent
Schwarz

(10) Patent No.: US 9,757,636 B1
(45) Date of Patent: Sep. 12, 2017

(54) ATHLETIC TRAINING DEVICE

(71) Applicant: Stephen F Schwarz, St. Petersburg, FL (US)

(72) Inventor: Stephen F Schwarz, St. Petersburg, FL (US)

( * ) Notice: Subject to any disclaimer, the term of this patent is extended or adjusted under 35 U.S.C. 154(b) by 0 days.

(21) Appl. No.: 14/793,944

(22) Filed: Jul. 8, 2015

Related U.S. Application Data

(63) Continuation-in-part of application No. 14/056,487, filed on Oct. 17, 2013, now abandoned.

(60) Provisional application No. 61/720,633, filed on Oct. 31, 2012.

(51) Int. Cl.
*A63B 69/00* (2006.01)
*A63B 53/06* (2015.01)

(52) U.S. Cl.
CPC .. *A63B 69/0002* (2013.01); *A63B 2069/0006* (2013.01); *A63B 2069/0008* (2013.01); *A63B 2208/0204* (2013.01)

(58) Field of Classification Search
CPC ..... A63B 69/0002; A63B 69/0075; A63B 69/3676; A63B 69/0079; A63B 69/0084; A63B 69/3667; A63B 69/3623; A63B 69/3644; A63B 69/3641; A63B 2069/0008; A63B 2208/0204; A63B 2208/02
USPC ..... 473/422, 452, 417, 451, 218; D21/780; 434/251, 252
See application file for complete search history.

(56) References Cited

U.S. PATENT DOCUMENTS 2,272,765 A * 2/1942 Beeson ..... A63B 69/0091 473/417
3,815,906 A * 6/1974 Hermo ..... A63B 69/0002 473/273
3,979,116 A 9/1976 Matchick
4,225,133 A * 9/1980 Kiray ..... A63B 69/0002 473/457
4,322,084 A * 3/1982 Reece ..... A63B 69/3667 473/273
4,516,772 A 5/1985 Stratton
4,664,375 A * 5/1987 Tetreault ..... A63B 69/0079 473/429
4,886,267 A * 12/1989 Licciardi ..... A63B 69/0075 473/417
5,066,010 A * 11/1991 Pingston ..... A63B 69/0002 473/451
5,106,085 A * 4/1992 Lewy ..... A63B 69/0002 473/417
5,435,727 A * 7/1995 Dobson ..... A63B 69/3667 473/218
5,516,115 A * 5/1996 McLain ..... A63B 63/00 473/451

(Continued)

*Primary Examiner* — Mitra Aryanpour
(74) *Attorney, Agent, or Firm* — Thomas Frost

(57) ABSTRACT

The present invention is an athletic training device, principally for baseball, comprised of a frame having a rear tubular member, base tubular member, a front tubular member and an adjustable and extendable pole. A rigid pad is mounted to the rear tubular member. Rear and front foot stride bars are mounted to the base tubular member and the pole, respectively. A front lateral bar is connected to the front tubular member. Use of the device for a particular individual is accomplished by repositioning the stride bars, front foot lateral bar and pad. The device permits the user to self correct stance, stride and body positioning while hitting, fielding, catching or pitching a baseball or softball.

7 Claims, 8 Drawing Sheets

(56) References Cited

U.S. PATENT DOCUMENTS

| | | | | | |
|---|---|---|---|---|---|
| D373,396 | S * | 9/1996 | Malwitz | D21/780 | |
| 5,595,384 | A * | 1/1997 | Hardison, Jr. | A63B 69/3644 | 473/417 |
| 5,613,677 | A | 3/1997 | Walker, Jr. | | |
| D430,243 | S * | 8/2000 | Alberti | D21/715 | |
| 6,579,195 | B2 | 6/2003 | Lamb | | |
| 6,666,781 | B1 * | 12/2003 | Illis | A63B 69/0002 | 473/417 |
| D486,197 | S * | 2/2004 | Marshall | D21/780 | |
| 6,916,256 | B1 * | 7/2005 | Buster | A63B 69/0002 | 473/422 |
| 6,926,625 | B1 | 8/2005 | Fruechting | | |
| 7,431,661 | B1 * | 10/2008 | Cailey | A63B 67/02 | 473/257 |
| 7,775,914 | B1 | 8/2010 | Greene | | |
| 8,221,271 | B1 | 7/2012 | McIntyre | | |
| D671,607 | S * | 11/2012 | Stogsdill | D21/780 | |
| 8,535,178 | B2 * | 9/2013 | Keller | A63B 63/003 | 473/417 |
| 9,457,252 | B2 * | 10/2016 | Schwarz | A63B 69/0002 | 473/417 |
| 2005/0288120 | A1 * | 12/2005 | Brescia | A63B 69/0002 | 473/452 |
| 2006/0035729 | A1 * | 2/2006 | Wang | A63B 69/0002 | 473/417 |
| 2007/0060421 | A1 * | 3/2007 | Distefano | A63B 69/0002 | 473/452 |
| 2010/0298074 | A1 * | 11/2010 | Esposito | A63B 69/00 | 473/438 |
| 2015/0094172 | A1 * | 4/2015 | Klein | A63B 69/0002 | 473/452 |
| 2015/0231471 | A1 * | 8/2015 | Craig | A63B 69/0002 | 473/452 |

* cited by examiner

ATHLETIC TRAINING DEVICE

BACKGROUND OF INVENTION

The present invention relates to, a portable training device, principally used for baseball, for correction of improper stance, stride, footwork or body positioning.

Other training devices exist that teach and correct proper footwork for hitting, fielding and throwing the baseball. However, these devices are not portable, nor are the devices adjustable depending upon the ability of age, skill and size of user.

It is an object of the invention to provide a portable device which is portable, and addresses the elements of baseball mechanics for a variety of users.

It is another object of the invention to provide an adjustable frame and rotatable stride bars to allow for balance and core strength training for a variety of skill levels.

SUMMARY OF THE INVENTION

The general purpose of the present invention, which will be described subsequently in greater detail, is to provide new and improved training device.

The invention is a frame comprised of a rear tubular member, base tubular member, a front tubular member and an extendable pole. The rear tubular member and the base tubular member are mounted to a first elbow corner piece, and the rear member is oriented substantially perpendicular to a first end of the base member. The pole is adjustably engaged at its first end with an inner chamber of a second end of the side bar. The front tubular member and the pole are mounted to a second elbow corner piece. The front member is oriented substantially perpendicular to a second end of the pole. The positioning of the front bar is adjusted by extending the pole.

A cylindrical sleeve is adjustably mounted on the pole and a front foot stride bar is connected to the cylindrical sleeve. A second cylindrical sleeve is adjustably mounted on the pole and a rear foot stride bar is connected to the second cylindrical sleeve. The stride bars are rotatable for proper alignment of foot stride and the like. A rigid pad is connected to the rear bar. A front foot lateral bar is mounted on the front bar and is moveable horizontally along the front, and can be rotated for alignment.

BRIEF DESCRIPTION OF THE DRAWINGS

The invention will be better understood and objects other than those set forth above will become apparent when consideration is given to the following detailed description thereof. Such description makes reference to the annexed drawings wherein.

DETAILED DESCRIPTION OF THE INVENTION

Figure 1:
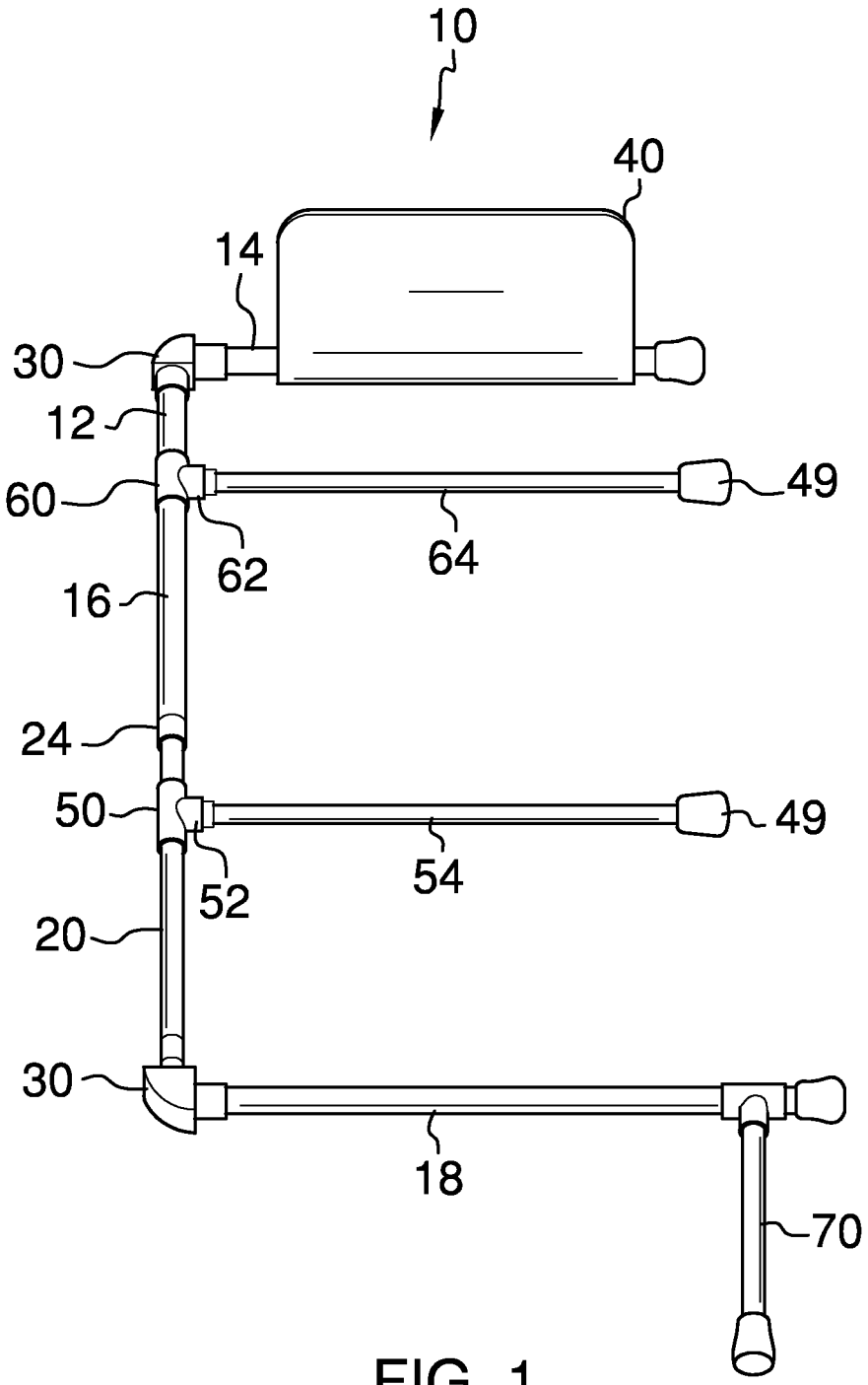
FIG. 1 is a top plan view of the present invention.

Referring to the drawings in general, an, embodiment of the present invention 10 will now be described in greater detail.

Figure 2:
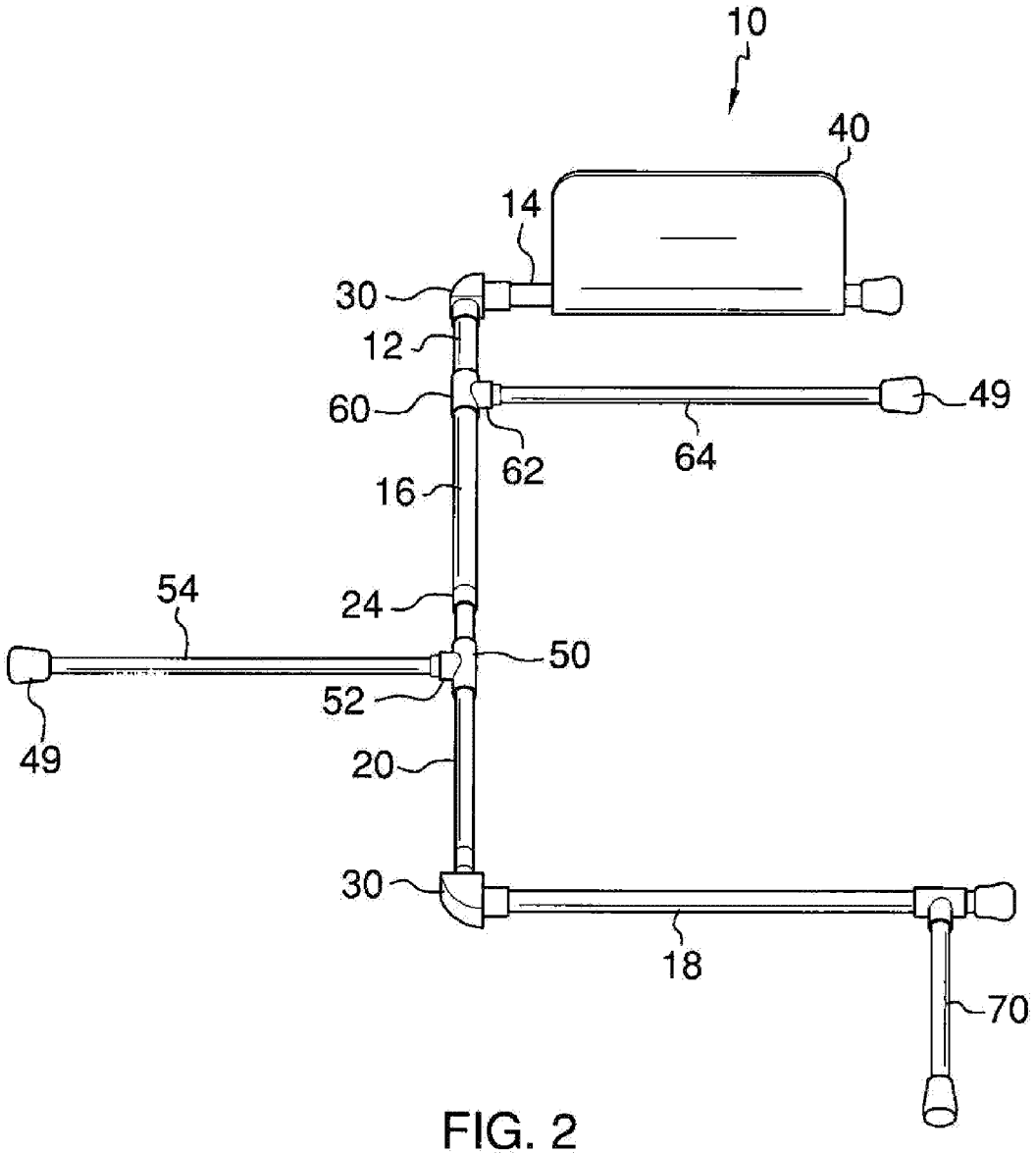
FIG. 2 is a top plan view of the present invention with a front foot lateral bar rotated 180 degrees.

In reference to FIGS. 1 and 2, an embodiment of the device, denoted generally by reference numeral 10, is shown. The device 10 includes a frame 12 comprised of a rear tubular member 14, a base tubular member 16, a front tubular member 18 and a pole 20. The base member 16 has an inner longitudinal channel defined therein. The rear tubular member 14 and front tubular member 18 each have a first end and a second end. The members and the pole are preferably formed of aluminum.

A generally triangular shaped corner piece 30, as illustrated in FIGS. 6*a*-6*e* preferably formed of non-skid material, has a generally triangular shaped shell 32 with side walls and a cavity defined therethrough and an opening defined at a first end. Tubular conduits 34 with apertures 36 formed on upper and lower surfaces of the tubular conduits 34 extend outwardly perpendicular to each other from the shell 32. The apertures 36 are of a pre-determined size to engage with snaps that can be formed on the members 14, 16. The shell 32 is affixed to a base platform 38. An insert 39 fits inside the cavity surface. The piece 30 is positioned adjacent the rear tubular member 14 and the base tubular member 16. The tubular outlets 34 are oriented perpendicular to each other. The first end of the rear member 14 is engaged with one of the outlets 34 and a first end of the base member 16 is engaged with the other tubular outlet 34. The rear member 14 thus orients substantially perpendicular to the base member 16. It should be recognized that the means to connect the tubular members to the corner piece are not limited to snaps, but could include other means such as inwardly/outwardly threaded surfaces. The platform 38 and the insert 39 are preferably formed of a non-skid material, such as rubber, with either side mountable on the ground surface.

Another corner piece 30 is positioned adjacent the front tubular member 18 and the pole 20. The tubular outlets 34 are oriented perpendicular to each other. The first end of the front member 18 is engaged with one of the outlets 34 and a second end of the pole 20 is engaged with the other tubular outlet 34. The front member 18 thus orients substantially perpendicular to the pole 20.

Figure 5:
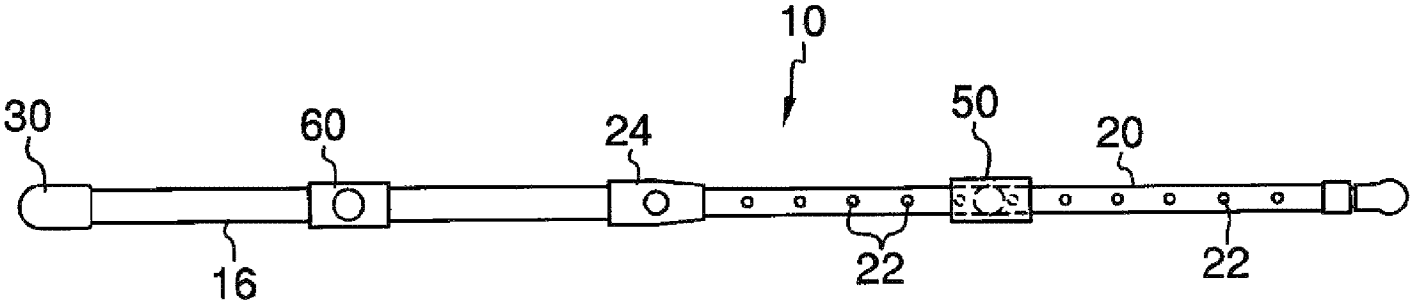
FIG. 5 is a side view of the invention with a pole extended.
Figure 6A:
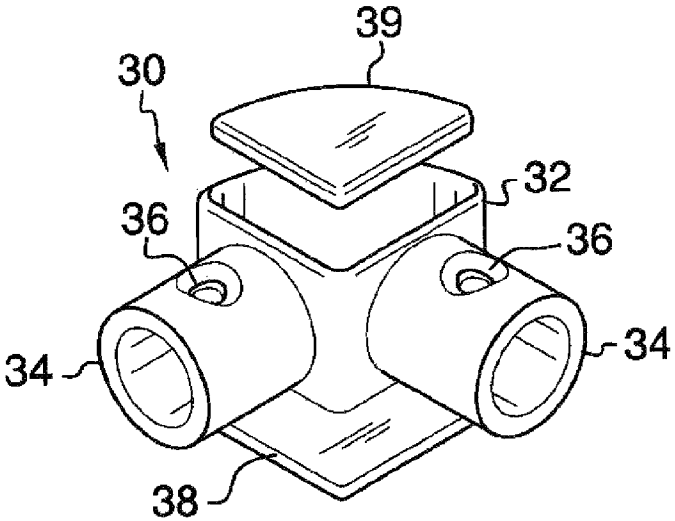
FIG. 6*a* is a frontal view of a corner piece.
Figure 6B:
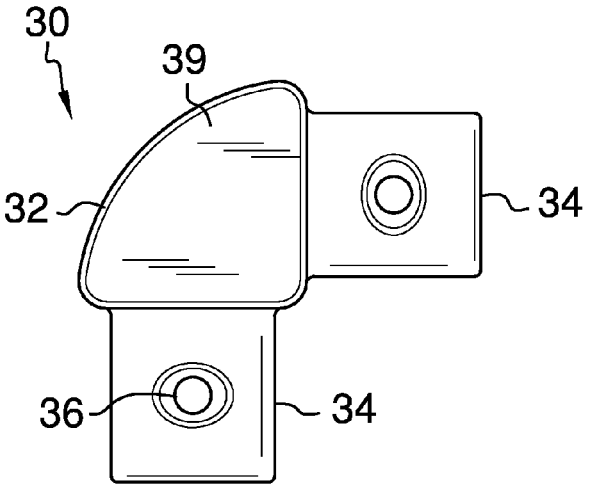
FIG. 6*b* is a top plan view of the corner piece, and 6*c* is a side view of the corner piece.
Figure 6C:
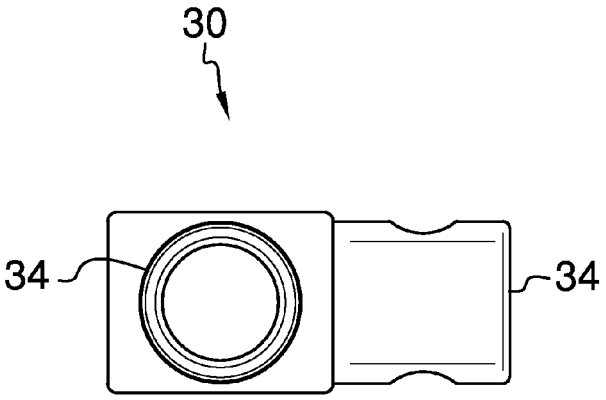

The pole 20 is of a predetermined size and engages at a first end with the inner longitudinal channel of the base member 16 at a second end, of the base member 16. As shown in FIG. 5, the pole 20 is telescoping and is generally oriented horizontally with respect to the ground from approximately 25" to 50." The pole 20 has a plurality of longitudinally spaced apertures 22 preferably formed at 1" increments along the longitudinal axis of the pole 20. A locking means 24 disposed at the second end of the base member 16 is provided to engage with the apertures 22 of the pole 20, and allows the pole 20 to be adjusted as needed. The locking means 24 disengaged when repositioning is needed. Rubber bushings stabilize the device 10 in one position during the use of one user.

The device 10 is designed for use on a planer surface, and non-skid coverings are on all corners and other surfaces of the device 10 touching the ground. It should also be recognized that the device 10 can be positioned on a planer surface in reverse image of FIG. 1 to accommodate a different use or user.

Figure 3:
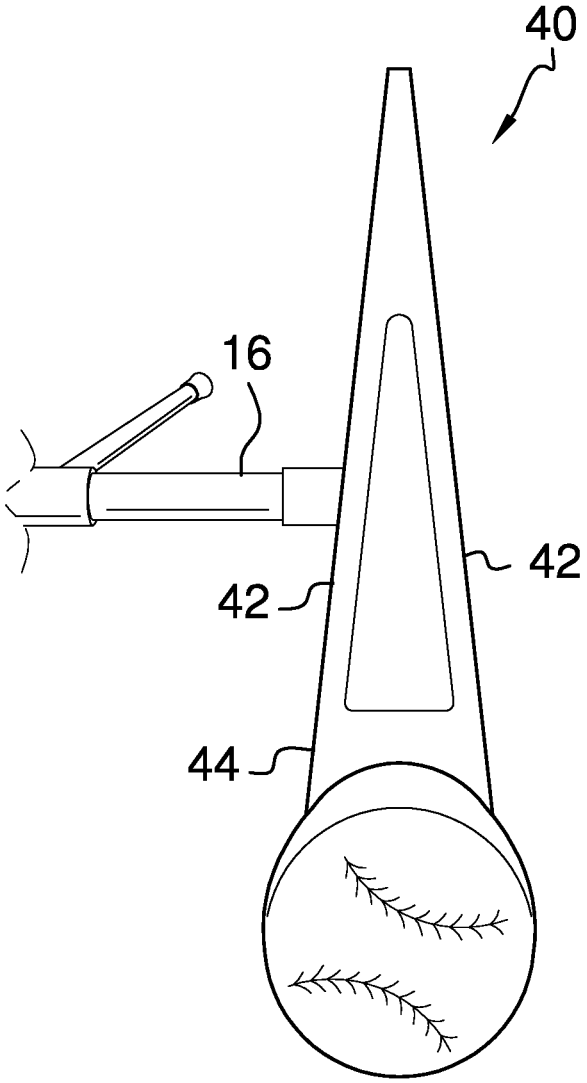
FIG. 3 is a cross-sectional front elevational view of a rigid pad mounted on a frame of the invention.

As illustrated in FIG. 3, a generally triangular shaped rigid pad 40 comprised of a pair of opposed platforms 42 having upper surfaces, being spaced apart and integrally joined at a first end. The platforms 42 are integrally joined at a second end to a cylindrical sleeve 44 pivotally mounted to the rear tubular member 14. The pad 40 is formed of non-skid rubber material and is capable of pivoting 180 degrees axially. The pad 40 positions at 90 degrees intervals using relief cutout that requires no buttons or tightening.

A cylindrical sleeve 50, having a longitudinal bore formed therethrough and a tubular outlet 52 oriented perpendicular to the bore, is mounted on the pole 20. A front foot stride bar 54 is engaged with the tubular outlet 35 of the cylindrical sleeve 34 at a first end. The front foot stride bar 54 has an inner channel defined therein and an opening defined at a second, end. The stride bar 54 is positioned along the pole 20 by sliding the sleeve 50. The sleeve 50 has a setting mechanism which allows the stride bar 54 to be set at 1" intervals along the pole 20. The stride bar 54 pivots for horizontal alignment as needed. The stride bar 54 is extendable through well known telescoping means ranging from 10" to 20" for different users. A detachable end cap 49 is mounted to the second end of the stride bar.

A second cylindrical sleeve 60, having a longitudinal bore formed therethrough and a tubular outlet 62 oriented perpendicular to the bore, is mounted on the base member 16. A rear foot stride bar 64 is engaged with the tubular outlet 62 of the cylindrical sleeve 60 at a first end. The rear foot stride bar 64 has an inner channel defined therein and an opening defined at its second end. As with the front stride bar 54, the rear stride bar 64 has a setting mechanism which allows the bar 64 to be set at 1" intervals, and can pivot up to substantially 360 degrees about an axis for horizontal alignment. The bar 64 is extendable through well known telescoping means ranging from 10" to 20" for different users. A detachable end cap 49 is mounted to the second end of the stride bar.

Figure 4:
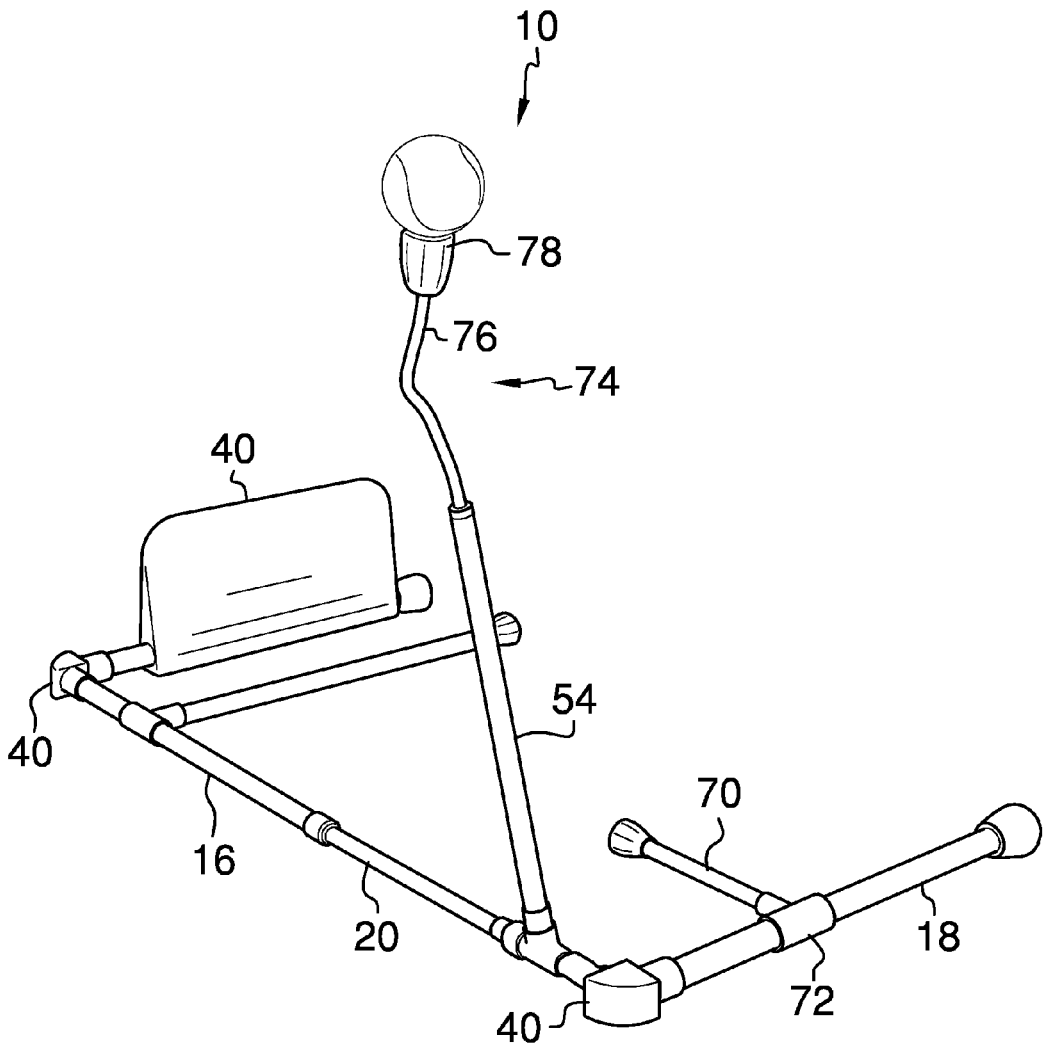
FIG. 4 is a perspective view with a support member and a baseball holder inserted in a front stride bar.

A front foot lateral bar 70, being generally oval in shape, is engaged with the front tubular member 18 via a sleeve 72. The lateral bar 70 is moveable horizontally along the front bar 18 to reposition as needed. The lateral bar 70 is preferably formed of rubber to withstand foot traffic, and is approximately 6 inches in length. As shown in FIGS. 1-2 and 4, relative to the front member 18, the lateral bar 70 can rotate 360 degrees for horizontal-vertical alignment.

As particularly shown in FIG. 4, the end cap 49 can be removed from the second end of the front foot stride bar 54 and a practice tee member 74 may be inserted into the opening. The tee member 74 is oriented as illustrated in FIG. 4. The tee member 74 is comprised of a gooseneck 76 having a first lower end and a second upper end, and composed of flexible material with a vinyl coating, inserted at the first lower end of the gooseneck into the second end of the front foot stride bar 54, and a baseball holder 78 having a concave area to mount a baseball or softball affixed to the second upper end of the gooseneck. The holder 78 is preferably formed of high impact rubber. The tee member 74 may also be inserted into the rear stride bar 64 by removing the end cap 49.

Figure 7:
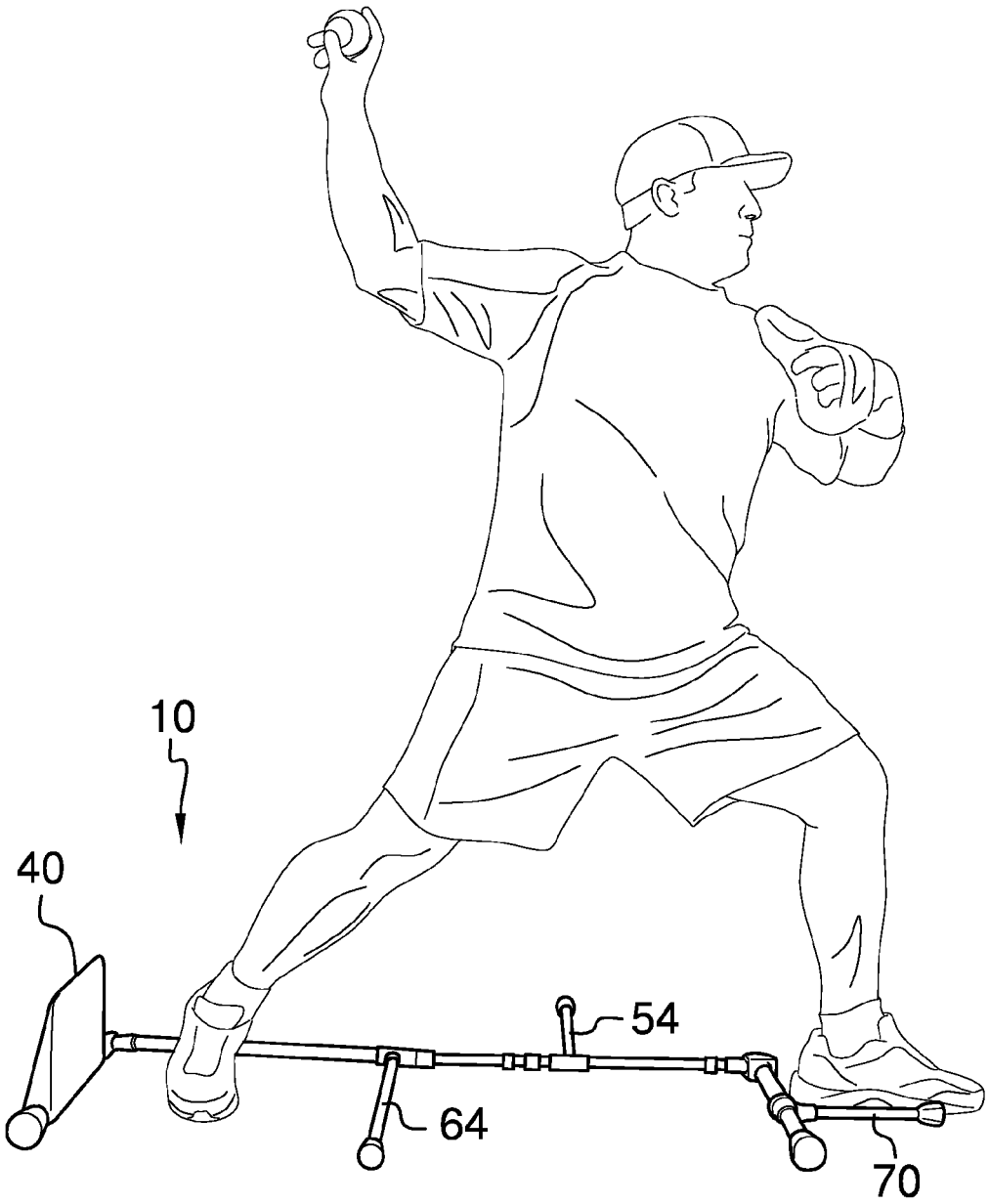
FIG. 7 illustrates the use of the invention by a baseball pitcher.
Figure 8:
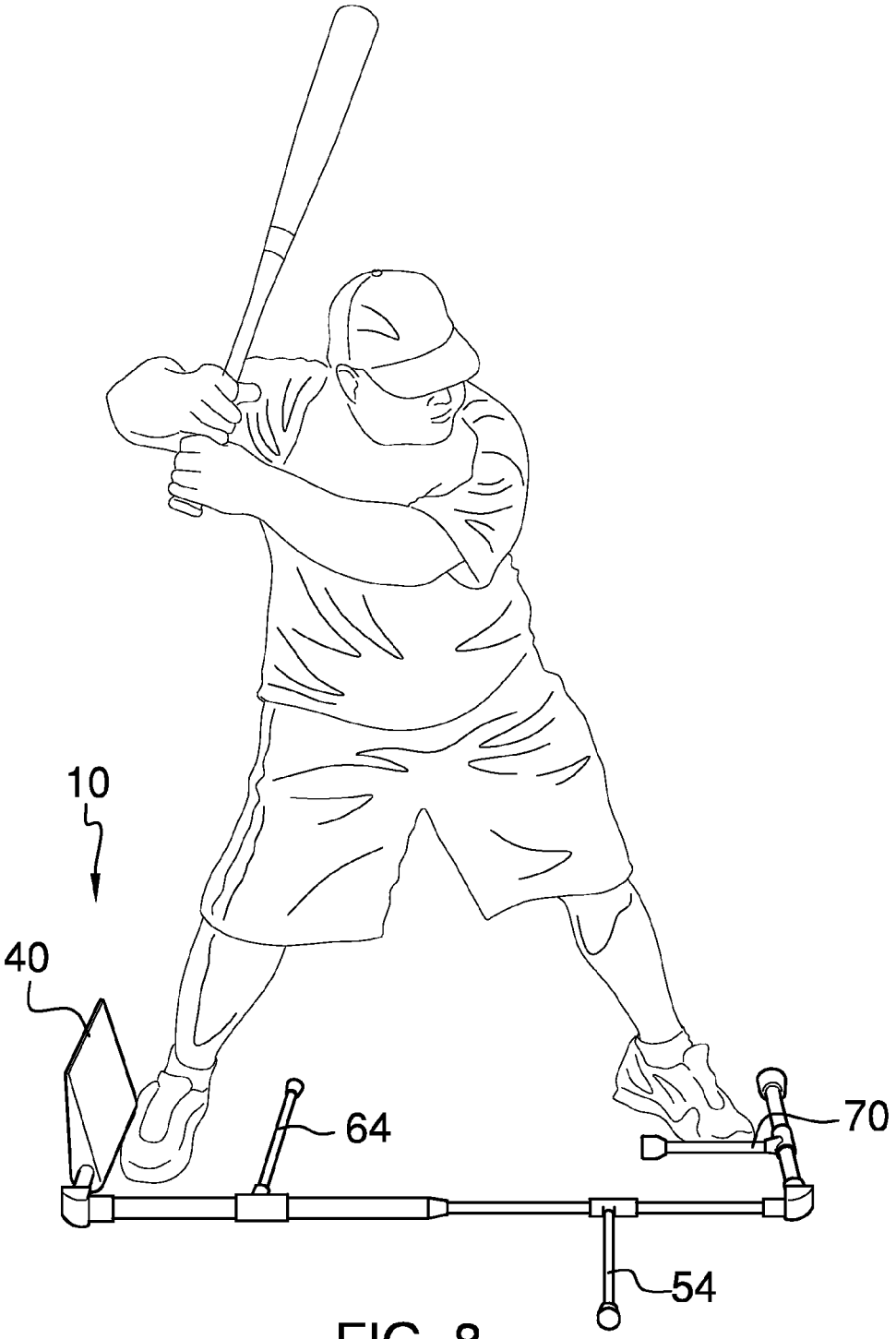
FIG. 8 illustrates the use of the invention by a baseball hitter.

The device permits the user to self correct stance, stride and body positioning while hitting, fielding, catching or pitching a baseball or softball. Various mechanics of baseball are illustrated in FIGS. 7-8. It, should, be recognized that the device is also adaptable to correct mechanics in other, sports, such as basketball and soccer. Use of the device for a particular individual is accomplished by repositioning the stride bars, front tubular member and pad. FIG. 7 illustrates the use of the rigid pad for proper pitching mechanics and foot stride. FIG. 8 illustrates a batter utilizing the pad positioned perpendicular to the rear tubular member as a buttress, striding into an area formed by placement of the front stride bar and front tubular member.

There has thus been outlined, rather broadly, the more important features of the invention in order that the detailed description thereof that follows may be better understood and in order that the present contribution to the art may be better appreciated. There are, of course, additional features of the invention that will be described hereinafter and which will form the subject matter of the claims attached.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description only and should not be regarded as limiting the scope and intent of the invention.

I claim:

1. An athletic training device, comprising in combination:

a first corner piece having a generally triangular shaped shell with side walls and a cavity defined therethrough, and having a pair of opposed tubular conduits which extend outwardly perpendicular to each other from the shell;

a second corner piece having a generally triangular shaped shell with side walls and a cavity defined therethrough, and having a pair of opposed tubular conduits which extend outwardly perpendicular to each other from the shell;

a base tubular member having an inner channel defined therethrough engaged at a first end of the base tubular member to the first tubular conduit of the first corner piece;

a rear tubular member engaged at a first end of the rear tubular member to the second tubular conduit of the first corner piece, and oriented substantially perpendicular to the base tubular member;

a first cylindrical sleeve, having a longitudinal bore formed therethrough and a tubular outlet oriented perpendicular to the bore, mounted to the base tubular member and rotatably repositionable about the base tubular member;

a rear foot stride bar having a first end and a second end, connected to the tubular outlet of the first cylindrical sleeve at the first end of the rear foot stride bar;

a pole having a first end slidably engaged with the inner channel of the base tubular member at a second end of the base tubular member, and further the pole being engaged at a second end of the pole to the first tubular conduit of the second corner piece;

a front tubular member engaged at a first end to the second tubular conduit of the second corner piece, and oriented substantially perpendicular to the pole; and a pad having a pair of opposed platforms with upper surfaces, the platforms being spaced apart and connected at a first end to each other, and connected at second ends of the platforms to a cylindrical sleeve pivotally mounted to the rear tubular member.

2. The device as set forth in claim 1, further comprising end caps connected to the second ends of the rear tubular member, rear foot stride bar and front tubular member.

3. The device as set forth in claim 2, further comprising a front foot stride bar having an inner channel defined therein and an opening defined at a second end of the stride bar, and connected at a first end of the stride bar to a cylindrical sleeve pivotally mounted on the pole, and whereby the sleeve has a setting mechanism which allows the stride bar and the sleeve to be repositionable along, the pole.

4. The device as set forth in claim 3, further comprising a gooseneck having a first lower end and a second upper end, and composed of flexible material with a vinyl coating, inserted at the first lower end of the gooseneck into the second end of the front foot stride bar, and a baseball holder having a concave area to mount a baseball or softball affixed to the second upper end of the gooseneck.

5. An athletic training device, comprising in combination:

a first corner piece having a generally triangular shaped shell with side walls and a cavity defined therethrough, and having a pair of opposed tubular conduits which extend outwardly perpendicular to each other from the shell;

a second corner piece having a generally triangular shaped shell with side walls and a cavity defined therethrough, and having a pair of opposed tubular conduits which extend outwardly perpendicular to each other from the shell;

a base tubular member having an inner channel defined therethrough engaged at a first end of the base tubular member to the first tubular conduit of the first corner piece;

a rear tubular member engaged at a first end of the rear tubular member to the second tubular conduit of the first corner piece, and oriented substantially perpendicular to the base tubular member;

a pole having longitudinally spaced apertures along a longitudinal axis of the pole and a first end of the pole slidably engaged with the inner channel of the base tubular member at a second end of the base tubular member, and further the pole being engaged at a second end of the pole to the first tubular conduit of the second corner piece;

a locking means disposed at the second end of the base tubular member to engage with the apertures of the pole, and whereby the pole is extendable generally oriented horizontally when the locking means disengage with the apertures;

a front tubular member engaged at a first end to the second tubular of the second corner piece, and oriented substantially perpendicular to the pole;

front foot stride bar having an inner channel defined therein and an opening defined at a second end of the stride bar, and connected at a first end of the stride bar to a cylindrical sleeve pivotally mounted on the pole, and whereby the sleeve has a setting mechanism which allows the stride bar and the sleeve to be repositionable along the pole; and a gooseneck having a first lower end and a second upper end, and composed of flexible material with a vinyl coating, inserted at the first lower end of the gooseneck into the second end of the front foot stride bar, and a baseball holder having a concave area to mount a baseball or softball affixed to the second upper end of the gooseneck.

6. The device as set forth in claim 5, further comprising a pad having a pair of opposed platforms with upper surfaces, the platforms being spaced apart and connected at a first end to each other, and connected at second ends of the platforms to a cylindrical sleeve pivotally mounted to the rear tubular member.

7. The device as set forth in claim 6, further comprising a front lateral bar joined to a sleeve mounted to the front tubular member, whereby the lateral bar is rotatable and moveable along the front tubular member.

* * * * *